US009019126B2

(12) United States Patent
Zarka et al.

(10) Patent No.: US 9,019,126 B2
(45) Date of Patent: Apr. 28, 2015

(54) TRAFFIC INFORMATION SYSTEM AND METHOD

(75) Inventors: Julien Zarka, Vitry sur Seine (FR); Aude Quintana, Chevilly Larue (FR); Jean-Jacques Tran, Villejuif (FR); Romain Gallet De Saint-Aurin, Villejuif (FR)

(73) Assignee: Mobile Devices Ingenierie, Villejuif (FR)

( * ) Notice: Subject to any disclaimer, the term of this patent is extended or adjusted under 35 U.S.C. 154(b) by 70 days.

(21) Appl. No.: 14/001,802

(22) PCT Filed: Mar. 2, 2011

(86) PCT No.: PCT/IB2011/000788

§ 371 (c)(1), (2), (4) Date: Aug. 27, 2013

(87) PCT Pub. No.: WO2012/117268

PCT Pub. Date: Sep. 7, 2012

(65) Prior Publication Data

US 2013/0335237 A1 Dec. 19, 2013

(51) Int. Cl.
*G08G 1/09* (2006.01)
*G08G 1/0967* (2006.01)

(52) U.S. Cl.
CPC ..... *G08G 1/0967* (2013.01); *G08G 1/096716* (2013.01); *G08G 1/096741* (2013.01); *G08G 1/096775* (2013.01)

(58) Field of Classification Search
CPC ..... G08G 1/0967; G08G 1/096716; G08G 1/096741; G08G 1/096775
USPC ..... 340/905, 988, 990, 992, 994, 995.1, 340/995.14; 701/300, 400, 408, 465, 468
See application file for complete search history.

(56) References Cited

U.S. PATENT DOCUMENTS

| | | | | |
|---|---|---|---|---|
| 6,587,777 | B1 | 7/2003 | St. Pierre | |
| 6,917,878 | B2 * | 7/2005 | Pechatnikov et al. | 340/988 |
| 7,222,018 | B2 | 5/2007 | Uyeki et al. | |
| 7,451,042 | B2 | 11/2008 | Uyeki et al. | |

(Continued)

FOREIGN PATENT DOCUMENTS

WO WO 2007/032576 3/2007

OTHER PUBLICATIONS

International Search Report and Written Opinion dated Nov. 23, 2011 for Application No. PCT/IB2011/000788.

*Primary Examiner* — Eric M Blount
(74) *Attorney, Agent, or Firm* — Frost Brown Todd LLC

(57) ABSTRACT

Method and system of traffic information comprising a mobile device (1) connected to a connected host server (2) via a wireless network (4), wherein said host server (2) is adapted to download updated standard traffic information xml files (6) from traffic information server (3) connected to the Internet (5), wherein the method comprises the steps of identifying the current GPS location of the mobile device and transmitting said current GPS location to the host server, defining a relevant area surrounding said current GPS location of the mobile device, extracting, from updated standard traffic information xml files, road segments totally or partially included in said relevant area, preparing and compressing a relevant subset of traffic info data, transmitting it to the mobile device, processing said subset of traffic info data in the mobile device to display traffic information.

15 Claims, 3 Drawing Sheets

(56) References Cited

U.S. PATENT DOCUMENTS 7,609,172 B2 * 10/2009 Rozum et al. ..... 340/901
7,671,764 B2 * 3/2010 Uyeki et al. ..... 340/905
2007/0281689 A1 * 12/2007 Altman et al. ..... 455/435.1
2009/0254272 A1 * 10/2009 Hendrey ..... 701/210
2010/0211425 A1 * 8/2010 Govindarajan ..... 701/300

* cited by examiner

Chartres
Courville-sur-Eure
Illiers Combray
Ihivers Châteaudun Illiers-Combray
N
D30
500m
D23
N23
D23
D30
D941
D921
D922
A11
D28
N10
30
33
33a
33b
18
32a
32
32b
31
43
41
42
40
41
70
52
54
53
55
13
14
12
51

TRAFFIC INFORMATION SYSTEM AND METHOD

FIELD OF THE DISCLOSURE

The present invention concerns traffic information systems including mobile devices and internet servers.

BACKGROUND OF THE DISCLOSURE

More precisely, the present invention concerns a traffic information system comprising:

at least a mobile device having a localization function adapted to determine a current location thereof, said mobile device being adapted at least to display a navigation route, a host server connected to Internet, at least a traffic information server, connected to Internet, adapted to provide updated standard traffic information files, said updated standard traffic information files comprising traffic information relative to a large territory, a communication channel between the mobile device and the host server, including a wireless portion, wherein the mobile device transmits said current location to the host server at least from time to time, wherein the host server is adapted to get updated standard traffic information files from the traffic information server.

Such a traffic information system is known from document US2007/0219715. However, there is a need to further optimize said communication channel, knowing the data rate limitations on the wireless interface, and the costs of communications on this communication channel.

SUMMARY OF THE DISCLOSURE

To this end, the present invention discloses a traffic information system, characterized in that the host server extracts and filters data contained in the updated standard traffic information files according at least to said current location, to result in a subset of traffic information data, which is transmitted to the mobile device, whereby only relevant information is transmitted to the mobile device, wherein the subset of traffic info data is further compressed in a binary compressed form.

Thanks to these dispositions, the flow of data transmitted through the channel is optimized regarding the limited data rate and the costs of the wireless communication, in particular in the case a GPRS-type wireless link, with regard to the higher data rates prevailing in the Internet.

In various embodiments of the invention, one may possibly have recourse in addition to one and/or other of the following arrangements:

the host server comprises a re-arranged file and a buffer file, the latter receiving the downloading of the updated file from the traffic information server, said re-arranged file being the result of a sorting operation on the buffer file, and subset of traffic information data being processed from said re-arranged file; whereby the process of reception of traffic information is uncorrelated from the process of sorting;

said re-arranged file is partitioned in a plurality of different portions, each portion comprising the data of a particular geographic zone; whereby the re-arranged file is optimized for the sorting operation;

said updated standard traffic information files comprises a table of road segment identifiers, each road segment identifier representing a road segment and having a set of traffic condition variables, each road segment having a bounding box defined in said re-arranged file;

the subset of traffic information data comprises data relative to a corridor of the planned route; whereby irrelevant information is disregarded;

the subset of traffic info data comprises data according to the zoom level currently displayed on the navigation device, said data comprising only traffic information of the road segments displayed at the current zoom level; whereby the volume of information is further optimized;

the subset of traffic information data has a size equal to or slightly below the internet standard Maximum Transmission Unit 'MTU', preferably below 1500 bytes; whereby the overheads of communication are decreased;

the subset of traffic info data has a size which is less than 1% of the size of updated standard traffic information files.

The invention also concerns a method of handling traffic information comprising a mobile device connected to a connected host server via a wireless network, wherein said host server is adapted to download updated standard traffic information files from at least a traffic information server connected to the Internet, wherein the method comprises the steps of:

identifying a current location of the mobile device transmitting said current location from the mobile device to the host server, defining, in the host server, a relevant area surrounding said current location of the mobile device, extracting, from updated standard traffic information files, road segments totally or partially included in said relevant area, preparing and compressing a relevant subset of traffic info data, transmitting said subset of traffic info data from the host server to the mobile device, processing said subset of traffic info data in the mobile device to at least display traffic information.

In various embodiments of the invention, one may possibly have recourse in addition to one and/or other of the following arrangements:

the method further comprises the step of:

identifying traffic information data relative the corridor of the planned route to be included in the relevant area comprised in the subset of traffic info data; whereby irrelevant information is disregarded;

the method further comprises the step of:

preparing a geographically partitioned re-arranged file comprising different portions, each portion comprising the data of a particular geographic zone;

the method further comprises the step of:

said updated standard traffic information files comprises a table of road segment identifiers, each road segment identifier representing a road segment and having a set of traffic condition variables, in particular a traffic status value, and the method further comprises the step of:

road segment identifiers are grouped by type of traffic status value, with a sub-list for each traffic status value;

said sub-list is optimized by one or several of the following steps:

a set of road segment identifiers with consecutives values is indicated by the value of the first road segment identifier of said set and a number indicating the number of consecutive road segment identifiers following the first one, re-indexing the road segment identifier sub-list to suppress the gaps greater than a predetermined value between two subsequent, a set of non consecutive road segment identifiers is indicated by the value of the first road segment identifier and other road segment identifiers are indicated by differential values separating each of said other road segment identifiers and the preceding road segment identifier, changing road segment identifiers absolute values into binary form;

the navigation device uses a zoom level to display current navigation map, and the method further comprises the step of:

eliminating traffic information relative to the road segments which do not show at said current zoom level; whereby the volume of information to transmit is further optimized.

BRIEF DESCRIPTION OF THE DRAWINGS

Other features and advantages of the invention appear from the following detailed description of one of its embodiments, given by way of non-limiting example, and with reference to the accompanying drawings.

In the drawings.

MORE DETAILED DESCRIPTION OF THE DISCLOSURE

In the figures, the same references denote identical or similar elements.

Figure 1:
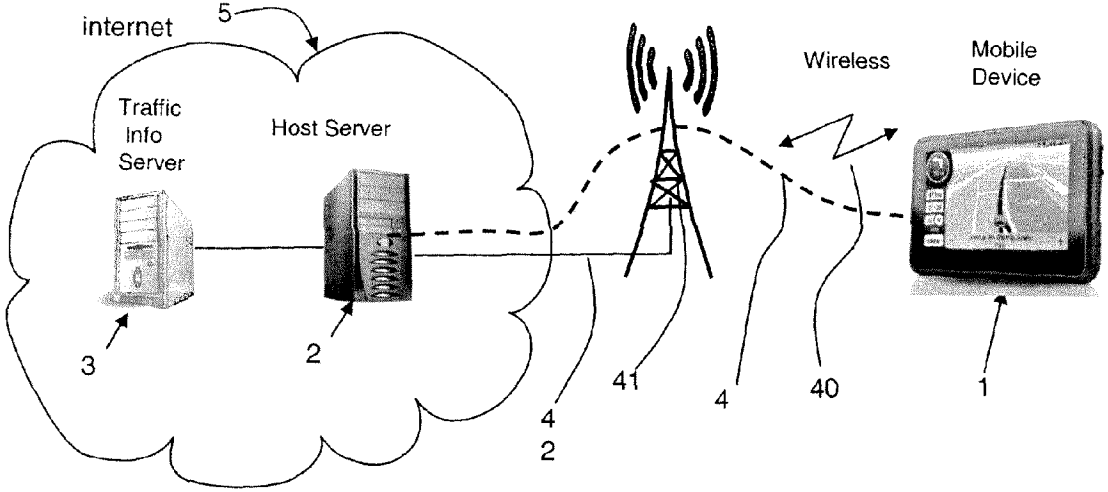
FIG. 1 is a schematic view of the traffic information system according to the invention.

FIG. 1 shows the traffic information system according to the invention, comprising at least a mobile device 1, and at least a host server 2, and a traffic information server 3.

Said host server 2 is functionally interposed between the mobile device 1 and one or several traffic information servers 3 connected to the Internet 5.

Said mobile device 1 may be for example a Personal Navigation Device ('PND'), or a smart phone; said mobile device 1 may be typically used in a vehicle, but can also be used by a pedestrian, a cyclist, or any transportation means.

The mobile device 1 is connected to the host server 2 via a communication channel 4 including a wired portion 42 and wireless portion 40, the latter relying on any suitable wireless communication means 41.

The wireless portion 40 can be a GSM, GPRS, CDMA UMTS, WiFi, 802.11x or any other wireless known protocol in the art. However, the data rate in the wireless portion 40 is not as high as in the wired portion 42.

Figure 2:
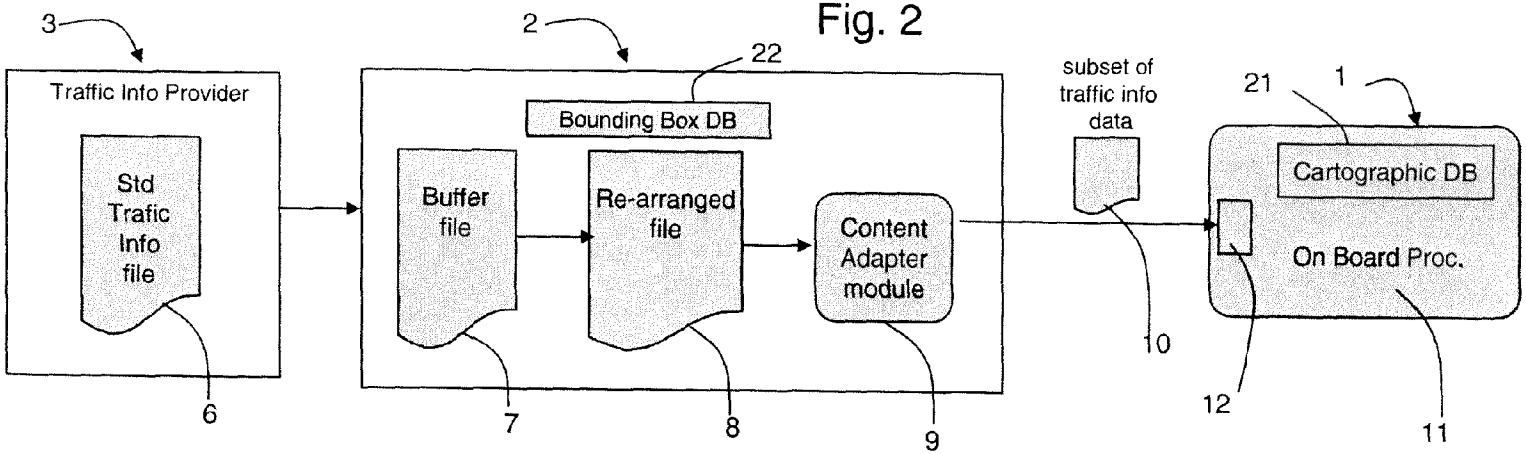
FIG. 2 is an organic chart of the system of FIG. 1.

Referring now to FIG. 2, a Traffic Information Provider makes available periodically, on a traffic information server 3, updated standard traffic information files 6. Usually, such periodic updated standard traffic information files 6 made available on the traffic information server 3 comply with the 'xml' format.

An example of the beginning of such a xml updated standard traffic information file 6 is given in Table 1 at the end of the present description.

More precisely, each updated standard traffic information file 6 comprises a table of road segments data organized by road segment identifiers also known as TMC codes. Each road segment identifier (or TMC code) represents a road segment and has a set of traffic condition variables and characteristics about the considered road segment, like the length of the segment, the direction of the segment, the standard travel time, the average speed, the jam factor, a confidence index, etc. . . .

In the example shown in Table 1, each TMC section begins with the tag 'FLOW_ITEM' and terminates with the tag '/FLOW_ITEM'.

Other details concerning the file extract illustrated in Table 1 are given below.

Updated standard traffic information file 6 usually contains the traffic information relative to a large territory, often a whole country, usually an area of more than 50 000 $km^2$, very often more than 200 000 $km^2$, which represents a large amount of information. The size of the updated standard traffic information file 6 is therefore rather big, very often more than 1 megabyte, rather often more than 10 megabytes.

Advantageously according to the invention, the host server 2, at least from time to time (it can be periodic), downloads the updated standard traffic information file 6 into a buffer file 7 from the traffic information server 3. Said buffer file 7 is in fact a local copy in the host server 2 of the remote updated standard traffic information file 6.

Further, the host server 2 periodically processes the buffer file 7 into a re-arranged file 8 by at least a sorting operation, as it will be explained here below.

Figure 4:
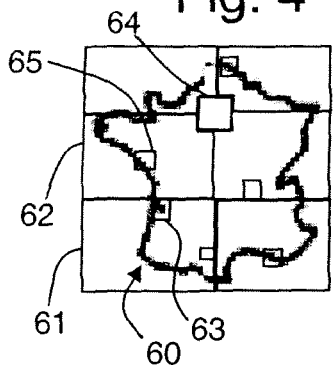
FIG. 4 is an example of territory partitioning.

The organization of the re-arranged file 8 relies on a geographic partitioning of the covered territory, as illustrated in FIG. 4. The whole territory 60 covered by the updated standard traffic information file 6 is partitioned in a plurality of different portions, each portion comprising the data of a particular geographic zone (61-65). Each particular geographic zone (61-65) is adjacent to other neighbouring geographic zones, so that the collection of all geographic zones constitutes the whole territory covered by the source updated standard traffic information file 6. As shown in FIG. 4, it can happen that one portion 65 is geographically located inside another bigger portion 62. The partitioning takes into account the density of road infrastructure. Each geographic zone (61-65) corresponds to a particular portion of the re-arranged file 8.

More precisely, the host server 2 parses the buffer file 7 across all TMC codes, and performs the following operations:

placing the corresponding road segment in the relevant portion corresponding to the relevant particular geographic zone (61-65), retrieving a bounding box corresponding to the road segment, and the associated geolocations (see below), appending said bounding box geolocations to the set of characteristics related to the road segment, in the relevant zone of the re-arranged file 8.

Figure 5:
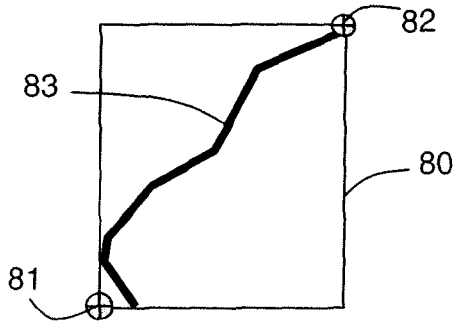
FIG. 5 illustrates a bounding box.

A bounding box 80, as illustrated in FIG. 5, is a geographic rectangle whose sides are parallel respectively to north-south and east-west directions, in which the road segment 83 is circumscribed. The bounding box can be defined by two geolocations 81,82 corresponding to the diagonally opposed corners. The bounding box 80 is retrieved from a bounding box file 22 which is contained in the host server 2 (see FIG. 1), said bounding box file 22 comprising a table of TCM codes related to road segments and coordinates of the two corners geolocations 81,82 of the bounding box enclosing the road segment 83.

It is to be noted that road segments that intersect the boundary between two geographic zones may be duplicated in the two said geographic zones.

Further, the mobile device 1 comprises a localization function adapted to determine a current location of the mobile device 1. Said mobile device 1 is adapted at least to display a navigation route on a display screen as known the art, thanks to a cartographic database 21 and an onboard processor 11.

The current location is determined using GPS, GLONASS, GALILEO or any other similar system.

The current location determined by the mobile device 1 is transmitted to the host server 2 at least from time to time, through the communication channel 4.

The host server 2 comprises a content adapter module 9. According at least to said mobile device current location, said content adapter module 9 extracts and filters data contained in the re-arranged file 8, and outputs the result of this process in a primary subset of traffic information data which is then compressed in a subset of traffic information data 10. At the other end, i.e. in the mobile device 1, a further adapter module 12 is adapted to uncompress the incoming subset of traffic information data 10 to be acceptable data for the on board navigation processor 11.

Figure 3:
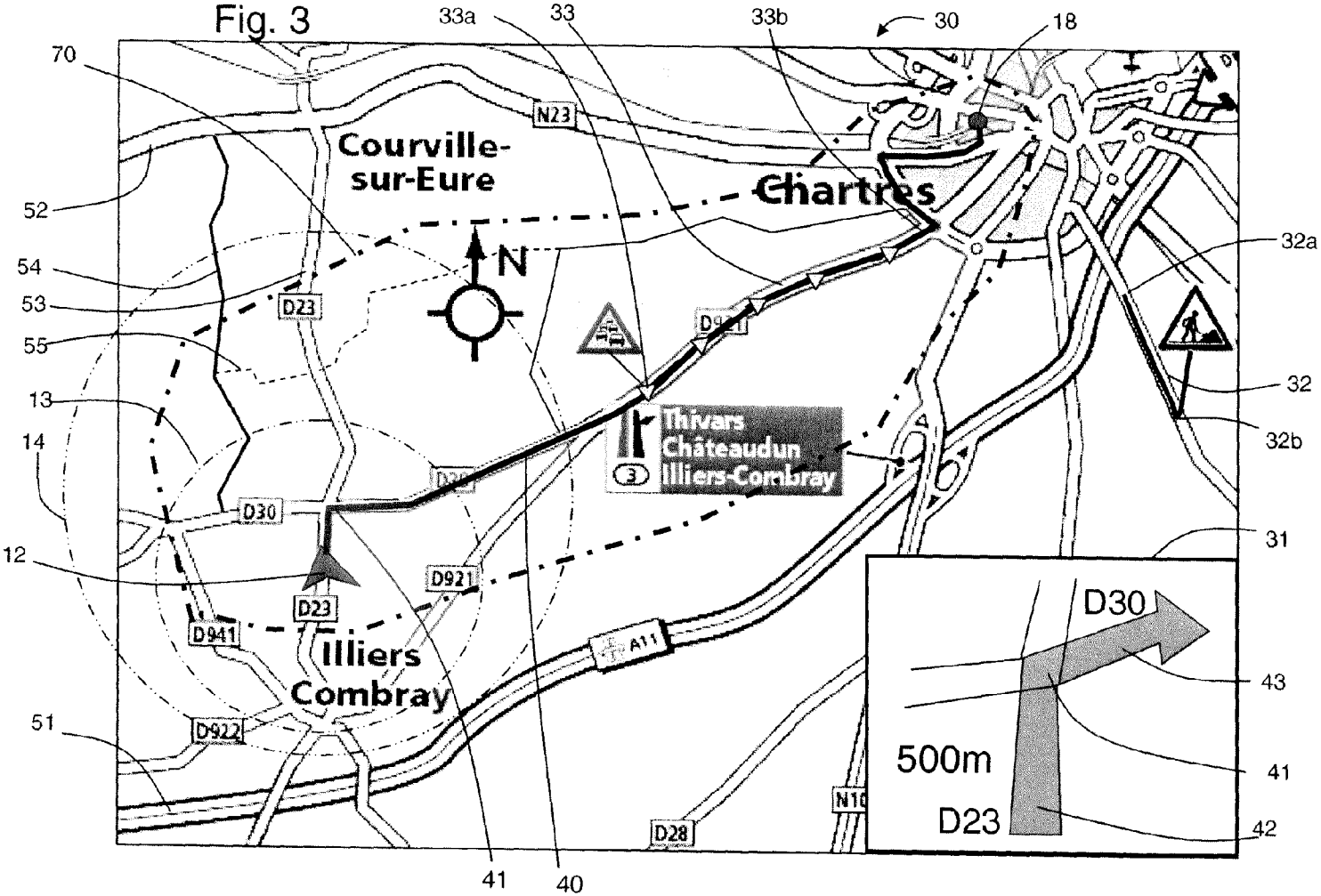
FIG. 3 shows an example of a navigation map displayed on a mobile device.

Referring now to FIG. 3, the current location is denoted by an arrow 12. According to the invention, the content adapter module 9 defines a relevant area surrounding said current location 12 of the mobile device 1.

Further referring to FIG. 3, the navigation display 30 comprises a window showing the instructions to be followed by the driver, for instance turning at the right at the next intersection 41 from road D23 (ref. 42) to road D30 (ref. 43).

The planned route 40 is highlighted from the current location 12 to the destination point 18.

The navigation display 30 may show traffic information received from the host server 2, like for example roadworks 32 starting at point 32*a* and ending a point 32*b*, or road congestion 33 starting at point 33*a* and ending a point 33*b*.

The cartographic database comprises vectorized road, and may comprise a road classification, in which the roads are allocated in a class according to their traffic capabilities. For instance, highways or interstate freeways are classified in the first class (like highway 51 in FIG. 3), state roads are classified in the second class (like state road 52 in FIG. 3), intermediate roads are classified in the third class (like road 53 in FIG. 3), small roads are classified in the fourth class (like small road 54 in FIG. 3), and vicinity roads are classified in the fifth class (like vicinity road 55 in FIG. 3).

With regard to zoom level in the display on the mobile device 1, only higher class roads are displayed, for example classes 1 to 3 in intermediate zoom level, only classes 1 to 2 when zooming out, or classes 1 to 4 when zooming in.

According to a first aspect of the invention, the content adapter module 9 extracts the road segments that are included totally or partially in a surrounding area 13,14 around the current location 12. The radius of the substantially circular or ovoid areas 13, 14 may depend on the density of the roads and/or may depend on the city or countryside type of environment.

According to a second aspect of the invention, the relevant area includes traffic information data relative the corridor 70 of the planned route 40. The extracted roads segments close to the planned route 40 are included in the primary subset of traffic info data to be sent back to the mobile device.

According to a third aspect of the invention, the content adapter module 9 extracts the road segments that appear on the current zoom level used on the display of the mobile device 1. Of course, this implies that the current zoom level used on the display of the mobile device is sent together with the current location to the host server, at least from time to time, or each time the zoom level is changed on the mobile device 1.

The content adapter module 9 therefore eliminates traffic information relative to the road segments which do not show at said current zoom level.

For instance, with regard to FIG. 3, road segment 55 does not show normally on the illustrated zoom level (it shows in doted line only for the purpose of this explanation), and the corresponding traffic information data will be disregarded.

Once the filtering and extraction of the relevant data is done according to the discussion above, the unnecessary information contained in each relevant TCM code section is discarded and the result is the primary subset of traffic info data as described hereafter:

file header (comprising the country code), a first list of TMC code with a positive direction, comprising a plurality of:

TMC code and traffic status, a second list of TMC code with a negative direction, comprising a plurality of:

TMC code and traffic status.

The traffic status is an index representing the current average speed ratio, that may have for example five different values, as illustrated in the following table:

| Value of traffic status | meaning | color shown on the map |
|---|---|---|
| 1 | 70% to 100% of normal speed | green |
| 2 | 33% to 70% of normal speed | yellow |
| 3 | <33% of normal speed | red |
| 4 | blocked road | black |
| 5 | data not available | grey |

The traffic status can be computed from the 'jam factor' of the TMC code section of the xml source file 6 (see section P10 of Table 1) or it can also be computed by dividing the current average speed (see section P8 of Table 1) by the freeflow average speed (see section P9 of Table 1) and assigning the result to one of the four value other than not available.

For instance, regarding the first list mentioned above, it can be like the following example:

| TMC code | traffic status |
|---|---|
| 10000 | 2 |
| 10001 | 5 |
| 10002 | 1 |
| 10003 | 1 |
| 10004 | 1 |
| 10005 | 1 |
| 10230 | 4 |
| 10231 | 1 |
| 10232 | 1 |
| 10238 | 1 |
| 10239 | 1 |
| 10670 | 1 |
| 10671 | 1 |
| 10673 | 1 |
| 10674 | 2 |
| 10675 | 1 |
| 10676 | 4 |
| 10680 | 1 |
| Etc . . . | |

Once the filtering and extraction of the relevant data is done according to the discussion above, further optimization operations are performed on the primary subset of traffic info data, as described here below.

A first optimization operation is to group together the TMC codes having the same traffic status, which results in the following exemplified file:

| traffic status | TMC code |
|---|---|
| 1 | 10002, 10003, 10004, 10005, 10231, 10232, 10238, 10239, 10670, 10671, 10673, 10675, 10680 |
| 2 | 10000, 10674 |
| 4 | 10230, 10676 |
| 5 | 10001 |

hence resulting in a sub-list of TMC codes for each value of traffic status value.

The advantage of this first optimization operation is to eliminate the repetition of the traffic status value.

According to another further aspect of this first optimization, the largest sub-list may be omitted in the transmission from the host server 2 to the mobile device 1, the mobile device 1 affects the non transmitted road segment identifiers with the missing value, in the particular case when the mobile device knows in advance all the expected TMC codes. Usually, the sub-list of TMC having the traffic status value equal to 1 can be omitted. The value for which no sub-list is received is assumed to be the value prevailing for all the TMC codes for which no TMC code has been updated.

A second optimization operation consists in identifying, within a sub-list of one particular traffic status value, rows of adjacent consecutive TMC codes, and instead of explicitly mentioning all the consecutives values, it is advantageous to indicate the number of consecutive following TMC codes and to omit the real value of consecutive following TMC codes. This second optimization operation results in the following exemplified file portion concerning traffic status value 1:

10002,4, 10231,1, 10238,1, 10670,1, 10673,0, 10675,0, 10680

The 'short' value which indicates the number of adjacent consecutive following TMC codes can be implemented on one byte or on a variable length field using UTF-8 standard, with a MSB bit to indicate the simple or double byte field. As a result, a set of TMC codes with adjacent consecutives values is indicated by the value of the first TMC code of said set and a number indicating the number of adjacent consecutive TMC codes following the first one.

According to a third optimization operation, two secondary sub-lists are created, one with TMC codes being followed by value different from 0 and another one with TMC codes being followed by value different equal to 0, where the 0 value will be omitted. The first secondary sub-list shows as followed on the same example:

10002,4, 10231,1, 10238,1, 10670,1, whereas the second secondary sub-list shows 10673, 10675, 10680, As 0 has been eliminated, the number of consecutive following TMC codes can be shifted by 1, i.e. the value 1 will be coded by 0, the value 2 coded by 1, the value 256 is coded by 255, etc.

Regarding the secondary sub-list of TMC codes, a fourth optimization operation is performed, i.e. a relative coding can be used instead of an absolute coding, as shown here:

10673, 10675, 10680, results in 10673, 2, 5, where the 'short' value is the difference between the last two TMC codes.

There are different possibilities to implement this technique to handle the case when the difference is more than a byte value:

each time the relative value is greater than one byte 255, the a new absolute value is inserted, the relative value is coded on a variable length field using UTF-8 standard, with a MSB bit to indicate the simple or double byte field.

As a result, a set of non consecutive TMC codes is indicated by the value of the first TMC code of other TMC codes are indicated by differential values separating each of said other TMC codes and its preceding TMC code.

Furthermore, a fifth optimization operation can be used in complement of the relative coding exposed just before. The big gaps in the source file 6 can be identified and eliminated, for instance in the exemplified filed above, there is no TMC codes between 10239 and 10670, and this gap is greater than 255, which would imply inserting an absolute TMC code value. This can be overcome by re-indexing the table of TMC codes, suppressing the gap bigger than a predetermined value, and keeping a table of re-indexation.

Finally, at least for the TMC code absolute values, the UTF-8 encoding is replaced by a binary encoding. For instance, 10673 is coded in binary '00101001 10110001', whereas it is coded in UTF-8 as '00110001' '00110000' '00110110' '00110111' '00110011' which are respectively characters '1', '0', '6', '7', '3'.

Preferably, the subset of traffic information data, after all the above mentioned optimization and binary coding, is then compressed through known means as 'zip' or 'zip' operation. Preferably, the resulting subset of traffic information data 10 has a size equal to or slightly below the internet standard Maximum Transmission Unit (also called 'MTU'), preferably below 1500 bytes in the case of standard TCP/IP communication, but this value may evolve over time. This calculation may take into account the overhead introduced by the transmission protocol.

Preferably, the size of the resulting subset of traffic information data 10 is less than 1% of the of updated standard traffic information file (6), and more preferably below 0.2%.

All the above mentioned optimizations are intended to reduce and limit the costs of infrastructure, the costs of communications, the time latency of said communications.

It is to be noted that the further adapter module 12 included in the mobile device has to perform exactly reverse operations from the subset of traffic information data 10 back into TMC code format that can be exploited by the onboard processor 11. This further adapter module 12 may have to know some information to perform the reverse operations, such the re-indexation table, which can be downloaded only once the re-indexation changes which is seldom.

It is also to be noted that the download of updated standard traffic information file 6 into the buffer file 7 can be a partial download, i.e. only refreshed information is downloaded and not the entire file. A 'refresh tag' can be added by the traffic information server 3 according to various criteria like time from last update or the like.

TABLE 1

Example of xml updated standard traffic information file (partial beginning of file).

| | Xml file content |
|---|---|
| file header | <?xml version="1.0"encoding="UTF-8" standalone="yes"?> |
| | = <TRAFFICML_REALTIME xmlns="trafficml50_reatime" |
| | VERSION="5.0" TIMESTAMP="10/01/2010 15:46:49 GMT" |
| | NAVNAV_VERSION="200904"> |
| P1 | <FLOW_ITEMS DIRECTION="+"> |
| P2 | <FLOW_ITEM> |
| P3 | <ID>F32+14492</ID> |
| P4 | <RDS_LINK> |
| P5 | <LOCATION> |
| | <EBU_COUNTRY_CODE>F</ |
| | EBU_COUNTRY_CODE> |
| | <TABLE_ID>32</TABLE_ID> |
| | <LOCATION_ID>14492</LOCATION_ID> |
| | <LOCATION_DESC>Paris - Porte de la Chapelle |
| | </LOCATION_DESC> |
| | <RDS_DIRECTION>-</RDS_DIRECTION> |
| | </LOCATION> |
| P6 | <LENGTH UNITS="mi">0.2897</LENGTH> |
| | </RDS_LINK> |
| P7 | <CURRENT_FLOW> |
| | <TRAVEL_TIMES> |
| | <LANE_TYPE TYPE="THRU"> |
| P8 | <TRAVEL_TIME TYPE="current"> |
| | <DURATION UNITS="min">0.47</DURATION> |
| | <AVERAGE_SPEED |
| | UNITS="mph">36.9</AVERAGE_SPEED> |
| | </TRAVEL_TIME> |
| P9 | <TRAVEL_TIME TYPE="freeflow"> |
| | <DURATION UNITS="min">0.35</DURATION> |
| | <AVERAGE_SPEED |
| | UNITS="mph">49.71</AVERAGE_SPEED> |
| | </TRAVEL_TIME> |
| | </LANE_TYPE> |
| | </TRAVEL_TIMES> |
| P10 | <JAM_FACTOR>3.78</JAM_FACTOR> |
| | <JAM_FACTOR_TREND>1</JAM_FACTOR_TREND> |
| | <CONFIDENCE>0.88</CONFIDENCE> |
| | </CURRENT_FLOW> |
| P11 | </FLOW_ITEM> |

The invention claimed is:

1. Traffic information system, comprising:

at least a mobile device having a localization function adapted to determine a current location thereof, said mobile device being adapted at least to display a navigation route, a host server connected to Internet, at least a traffic information server, connected to Internet, adapted to provide updated standard traffic information files, said updated standard traffic information files comprising traffic information relative to a large territory, a communication channel between the mobile device and the host server, including a wireless portion, wherein the mobile device transmits said current location to the host server at least from time to time, wherein the host server is adapted to get updated standard traffic information files from the traffic information server, at least from time to time, characterized in that the host server extracts and filters data contained in the updated standard traffic information files according at least to said current location, to result in a subset of traffic information data, which is transmitted to the mobile device, wherein the subset of traffic info data is further compressed in a binary compressed form.

2. Traffic information system according to claim 1, wherein the host server comprises a re-arranged file and a buffer file, the latter receiving the downloading of the updated file from the traffic information server, said re-arranged file being the result of a sorting operation on the buffer file, and subset of traffic information data being processed from said re-arranged file.

3. Traffic information system according to claim 2, wherein said re-arranged file is partitioned in a plurality of different portions, each portion comprising the data of a particular geographic zone.

4. Traffic information system according to claim 2, wherein said updated standard traffic information files comprises a table of road segment identifiers, each road segment identifier representing a road segment and having a set of traffic condition variables, each road segment having a bounding box defined in said re-arranged file.

5. Traffic information system according to claim 1, wherein the subset of traffic information data comprises data relative to a corridor of the planned route.

6. Traffic information system according to claim 1, wherein the subset of traffic info data comprises data according to the zoom level currently displayed on the navigation device, said data comprising only traffic information of the road segments displayed at the current zoom level.

7. Traffic information system according to claim 1, wherein the subset of traffic information data has a size equal to or slightly below the internet standard Maximum Transmission Unit 'MTU'.

8. Traffic information system according to claim 1, wherein the subset of traffic info data has a size which is less than 1% of the size of updated standard traffic information files.

9. Method of handling traffic information in a traffic information system comprising a mobile device connected to a connected host server via a wireless network, wherein said host server is adapted to download updated standard traffic information files from a traffic information server connected to the Internet, wherein the method comprises the steps of:

identifying a current location of the mobile device, transmitting said current location from the mobile device to the host server, defining, in the host server, a relevant area surrounding said current location of the mobile device, extracting, from updated standard traffic information files, road segments totally or partially included in said relevant area, preparing and compressing a relevant subset of traffic info data, transmitting said subset of traffic info data from the host server to the mobile device, processing said subset of traffic info data in the mobile device to at least display traffic information.

10. Method of handling traffic information according to claim 9, further comprising the step of:

identifying traffic information data relative the corridor of the planned route to be included in the relevant area comprised in the subset of traffic info data.

11. Method of handling traffic information according to claim 9, further comprising the initial step of:

preparing a geographically partitioned re-arranged file comprising different portions, each portion comprising the data of a particular geographic zone.

12. Method of handling traffic information according to claim 9, wherein said updated standard traffic information files comprises a table of road segment identifiers, each road segment identifier representing a road segment and having a set of traffic condition varibles, in particular a traffic status value further comprising the step of:

road segment identifiers are grouped by type of traffic status value, with a sub-list for each traffic status value.

13. Method of handling traffic information according to claim 12, wherein the sub-list having the largest size is omitted in the transmission from the host server to the mobile device, and wherein the mobile device affects the non transmitted road segment identifiers with the missing value.

14. Method of handling traffic information according to claim 12, wherein said sub-list is optimized by one or several of the following steps:

a set of road segment identifiers with consecutives values is indicated by the value of the first road segment identifier of said set and a number indicating the number of consecutive road segment identifiers following the first one, re-indexing the road segment identifier sub-list to suppress the gaps greater than a predetermined value between two subsequent road segment identifiers, a set of non consecutive road segment identifiers is indicated by the value of the first road segment identifier and other road segment identifiers are indicated by differential values separating each of said other road segment identifiers are indicated by differential values separating each of said other road segment identifiers and the preceding road segment identifier, changing road segment identifiers absolute values into binary form.

15. Method of handling traffic information according to claim 9, wherein the navigation device uses a zoom level to display current navigation map, further comprising the step of:

eliminating traffic information relative to the road segments which do not show at said current zoom level.

* * * * *